US011583862B2

(12) United States Patent
Boo et al.

(10) Patent No.: US 11,583,862 B2
(45) Date of Patent: Feb. 21, 2023

(54) SYSTEMS AND METHODS FOR BIOLOGICAL ANALYSIS

(71) Applicant: LIFE TECHNOLOGIES CORPORATION, Carlsbad, CA (US)

(72) Inventors: Kuan Moon Boo, Singapore (SG); Wei Fuh Teo, Singapore (SG); Wuh Ken Loh, Singapore (SG); Zeqi Tan, Singapore (SG); Siew Yin Lee, Singapore (SG)

(73) Assignee: Life Technologies Corporation, Carlsbad, CA (US)

( * ) Notice: Subject to any disclaimer, the term of this patent is extended or adjusted under 35 U.S.C. 154(b) by 0 days.

(21) Appl. No.: 15/266,943

(22) Filed: Sep. 15, 2016

(65) Prior Publication Data

US 2017/0072398 A1 Mar. 16, 2017

Related U.S. Application Data

(60) Provisional application No. 62/270,975, filed on Dec. 22, 2015, provisional application No. 62/218,948, filed on Sep. 15, 2015.

(51) Int. Cl.
*B01L 7/00* (2006.01)
*B01L 9/00* (2006.01)
(Continued)

(52) U.S. Cl.
CPC ..... *B01L 7/52* (2013.01); *F25B 21/04* (2013.01); *B01L 2200/025* (2013.01);
(Continued)

(58) Field of Classification Search
CPC ..... B01L 2200/025; B01L 2200/04; B01L 2200/147; B01L 2300/0829;
(Continued)

(56) References Cited

U.S. PATENT DOCUMENTS

2004/0033592 A1 2/2004 Shin et al.
2005/0145273 A1 7/2005 Atwood et al.
(Continued)

FOREIGN PATENT DOCUMENTS

CN 102181360 A 9/2011
EP 2338599 A1 6/2011
(Continued)

OTHER PUBLICATIONS

PCT/US2016/051983, "International Search Report dated", Feb. 8, 2017, 3 Pages.
(Continued)

*Primary Examiner* — Lydia Edwards
(74) *Attorney, Agent, or Firm* — François A. Pelaez

(57) ABSTRACT

A thermal block assembly for use in a biological analysis system includes a sample block, a heating and cooling element, a heat sink including a surface, the surface including a plurality of projections for engaging the heating and cooling element to hold the heating and cooling element on the heat sink. A thermal block assembly for use in a biological analysis system includes a heating and cooling element, a sample block including a lower surface configured to be thermally coupled to the heating and cooling element, one or more temperature sensors configured to extend through the one or more slots of the lower surface of the sample block, and one or more thermal pads between the one or more temperature sensors and heating and cooling element.

2 Claims, 15 Drawing Sheets

(51) Int. Cl.
*B01L 99/00* (2010.01)
*F25B 21/04* (2006.01)

(52) U.S. Cl.
CPC ..... *B01L 2200/04* (2013.01); *B01L 2200/147* (2013.01); *B01L 2300/0829* (2013.01); *B01L 2300/1822* (2013.01); *F25B 2321/0251* (2013.01)

(58) Field of Classification Search
CPC .... B01L 2300/1822; B01L 7/52; F25B 21/04; F25B 2321/0251
See application file for complete search history.

(56) References Cited

U.S. PATENT DOCUMENTS

2006/0065652 A1 3/2006 Brown
2010/0193498 A1* 8/2010 Walsh ..... F24H 3/002 219/217
2011/0151519 A1 6/2011 Tasoh et al.
2013/0137144 A1 5/2013 Chu et al.
2014/0323358 A1* 10/2014 Oldham ..... B01L 3/5025 506/37
2015/0217292 A1 8/2015 Ng et al.

FOREIGN PATENT DOCUMENTS

JP 2001521379 A 11/2001
JP 2008543316 A 12/2008
JP 2010502228 A 1/2010
WO WO-2015039014 A1 3/2015
WO WO-2015126621 A1 8/2015
WO WO-2017048987 A1 3/2017

OTHER PUBLICATIONS

Chinese Second Office Action for Application No. CN201680059579.6, dated Apr. 7, 2021, 10 pages.

* cited by examiner

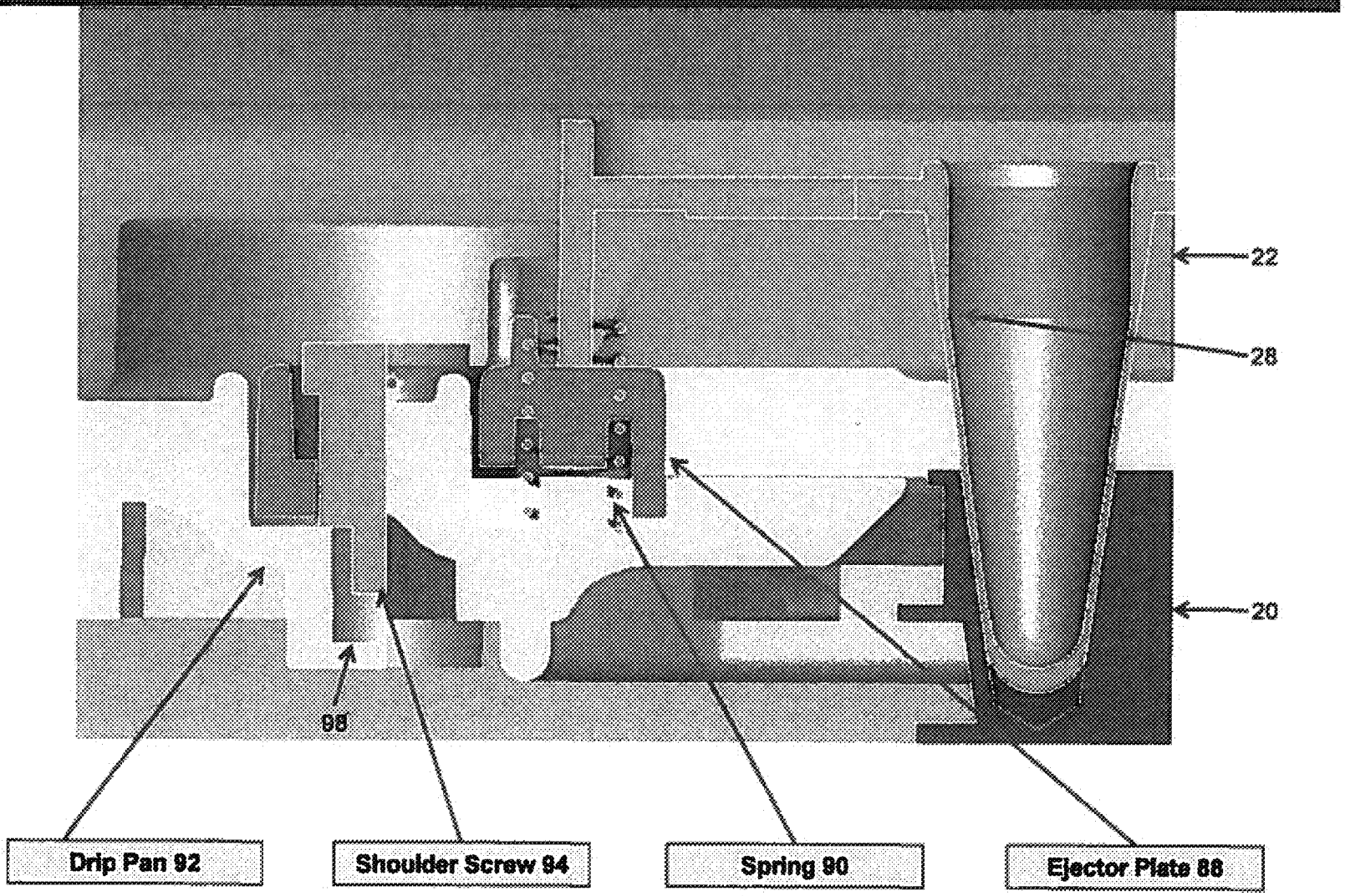
FIG. 15A: Compression – Heated Cover down

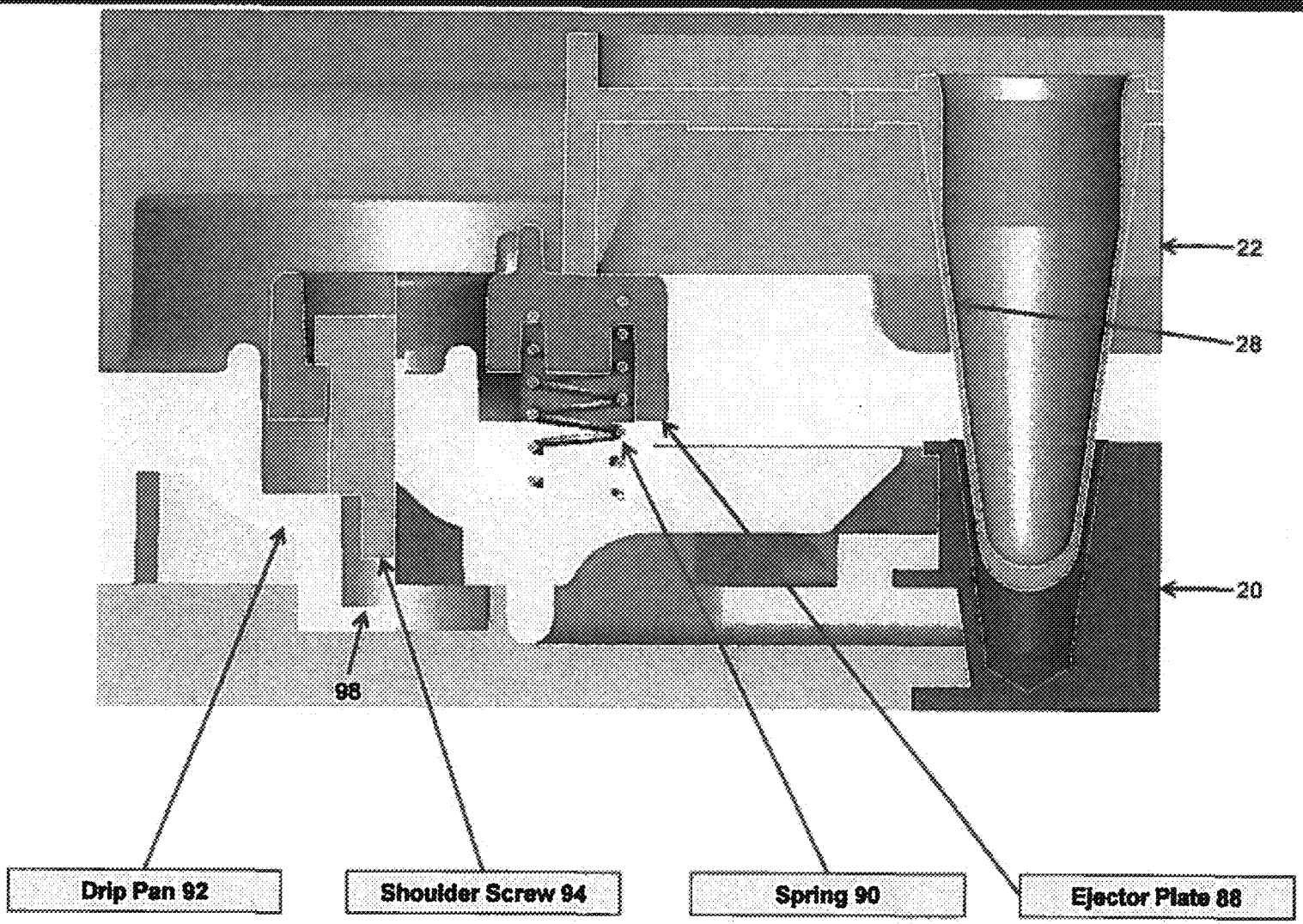
FIG. 15B: Ejection – Heated Cover Up

SYSTEMS AND METHODS FOR BIOLOGICAL ANALYSIS

CROSS-REFERENCE TO RELATED APPLICATIONS

This application claims priority under 35 U.S.C. § 119(e) from U.S. Provisional Patent Application No. 62/218,948 filed Sep. 15, 2015 and U.S. Provisional Patent Application No. 62/270,975 filed Dec. 22, 2015, both of which are incorporated herein by reference.

TECHNICAL FIELD

The present invention relates generally to systems and methods for biological analysis, and more particularly, to thermal cyclers and methods of using same.

BACKGROUND

Testing of biological or chemical samples often requires a device for repeatedly subjecting multiple samples though a series of temperature cycles. Such devices are described as thermal cyclers or thermocycling devices and are used to generate specific temperature cycles, i.e. to set predetermined temperatures in the reaction vessels to be maintained for predetermined intervals of time.

Generally, in the case of PCR, it is desirable to change the sample temperature between the required temperatures in the cycle as quickly as possible for several reasons. Firstly, the chemical reaction has an optimum temperature for each of its stages and as such less time spent at non-optimum temperatures means a better chemical result is achieved. Secondly, a minimum time is usually required at any given set point which sets a minimum cycle time and any time spent in transition between set points adds to this minimum time. Since the number of cycles is usually quite large, this transition time can significantly add to the total time needed to complete the amplification.

As the sample block changes temperature, the samples in the various wells experience similar changes in temperature. Temperature gradients often exist within thermal block assembly, causing some samples to have different temperatures than others at particular times in the cycle. Further, there are delays in transferring heat from the heating and cooling elements, sample block, and samples, and those delays may differ across the sample block. These differences in temperature and delays in heat transfer cause the yield of the PCR process to differ from sample to sample depending on the location of the sample in the sample block. Differences in the yield form the PCR process that result from the location of the sample in the sample block can decrease the reliability of the data obtained from the PCR reaction. Additionally, irregularities in the heat sink can produce deviations in the heating and cooling of the sample block. This is a particular problem in devices that utilize screws or clamps to maintain the relative positions of the sample block, the heating and cooling element, and the heat sink. To perform the PCR process successfully, efficiently, and accurately, these time delays and temperature irregularities must be minimized to the greatest extent possible.

There is an increasing need to provide improved biological analysis systems that address one or more of the above drawbacks.

SUMMARY

In one embodiment, a thermal block assembly for use in a biological analysis system includes a sample block configured to accommodate a sample holder, the sample holder configured to receive a plurality of samples, a heating and cooling element, and a heat sink including a surface. The surface includes a plurality of projections for engaging the heating and cooling element to hold the heating and cooling element on the heat sink.

In another embodiment, a thermal block assembly for use in a biological analysis system includes a heating and cooling element and a sample block having an upper surface with one or more cavities configured to accommodate a sample holder. The sample block includes a lower surface configured to be thermally coupled to the heating and cooling element, the lower surface including one or more slots. The thermal block assembly further includes one or more temperature sensors configured to extend through the one or more slots of the lower surface of the sample block and one or more thermal pads between the one or more temperature sensors and heating and cooling element.

In another embodiment, a biological analysis system for use with a sample holder configured to receive a plurality of samples includes a sample block configured to accommodate the sample holder, a heating and cooling element, a heat sink, and a drip pan. The drip pan is for engaging the sample block to seal the heating and cooling element and the heat sink from the plurality of samples in the sample holder when the sample holder is positioned on the sample block. The drip pan includes an ejection mechanism for ejecting the sample holder from the sample block.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

FIG. 15A is a cross-sectional view of the ejection mechanism of FIG. 14 where the ejection mechanism is in the engaged state.

FIG. 15B is a cross-sectional view of the ejection mechanism of FIG. 14 where the ejection mechanism is in the unengaged state.

DETAILED DESCRIPTION

Figure 1:
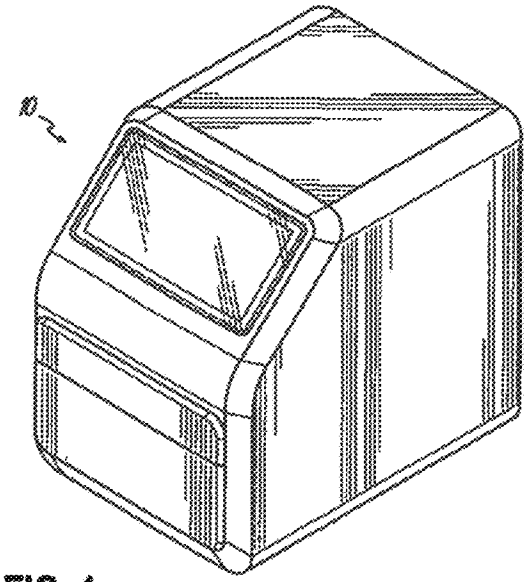
FIG. 1 is a perspective view of a biological analysis system according to one embodiment.
Figure 2:
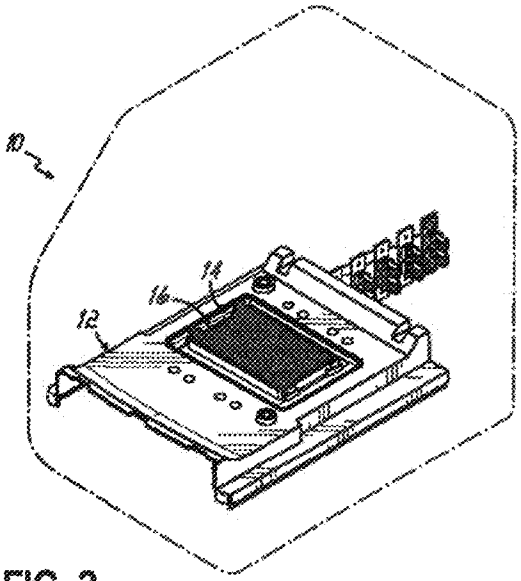
FIGS. 2 and 3 are perspective views of a portion of the biological analysis system of FIG. 1.
Figure 3:
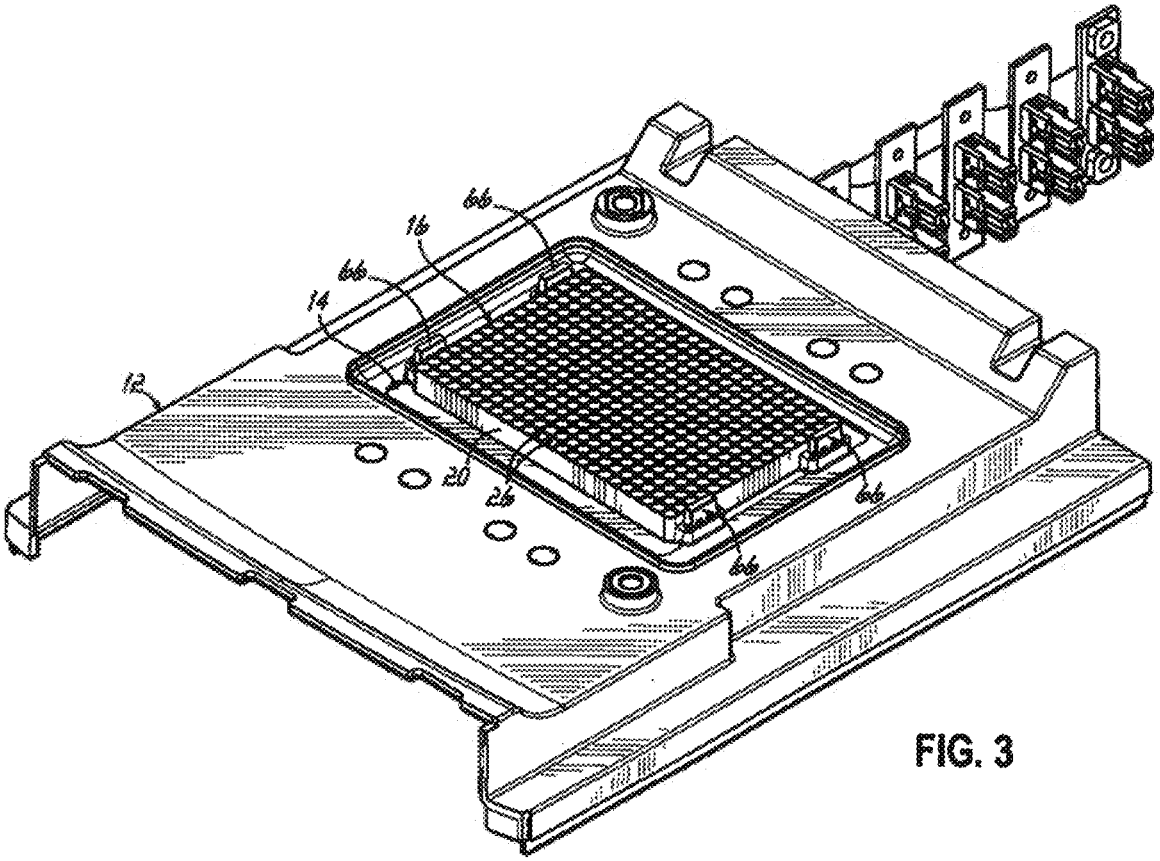
Figure 4:
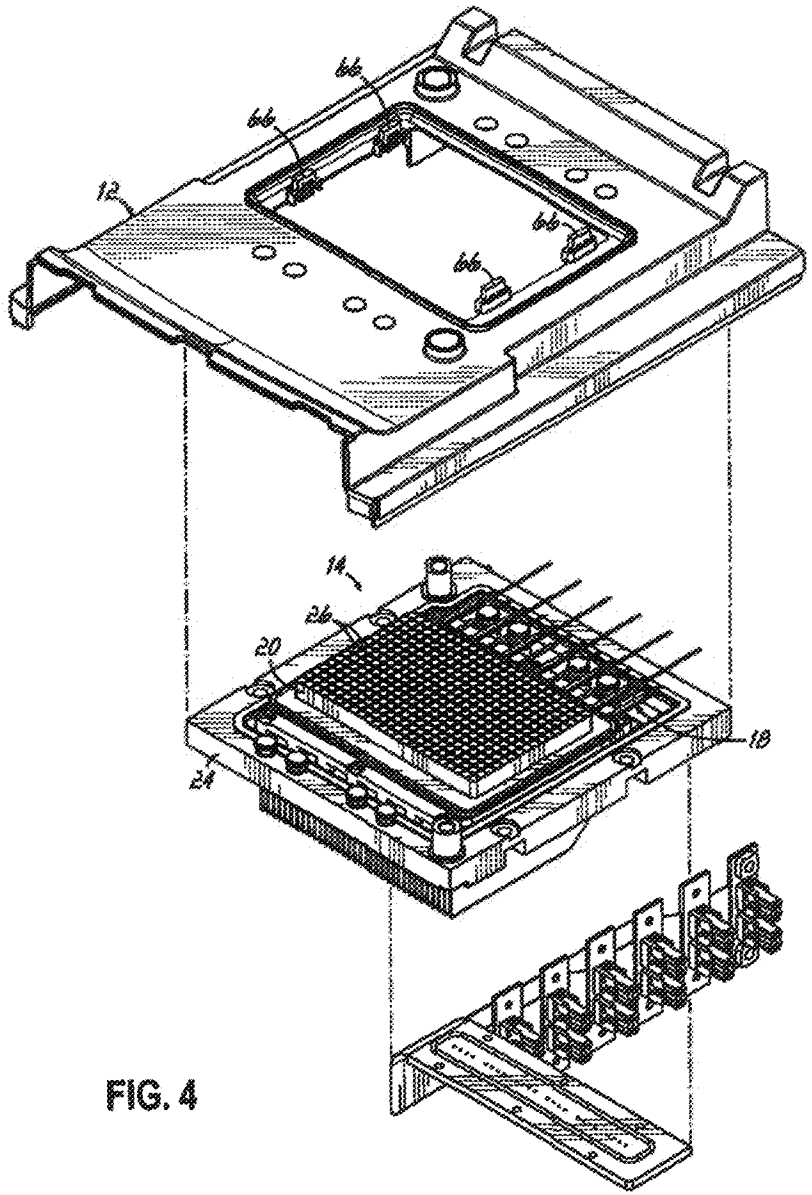
FIG. 4 is an exploded view of the portion of the biological analysis system of FIG. 2.
Figure 5:
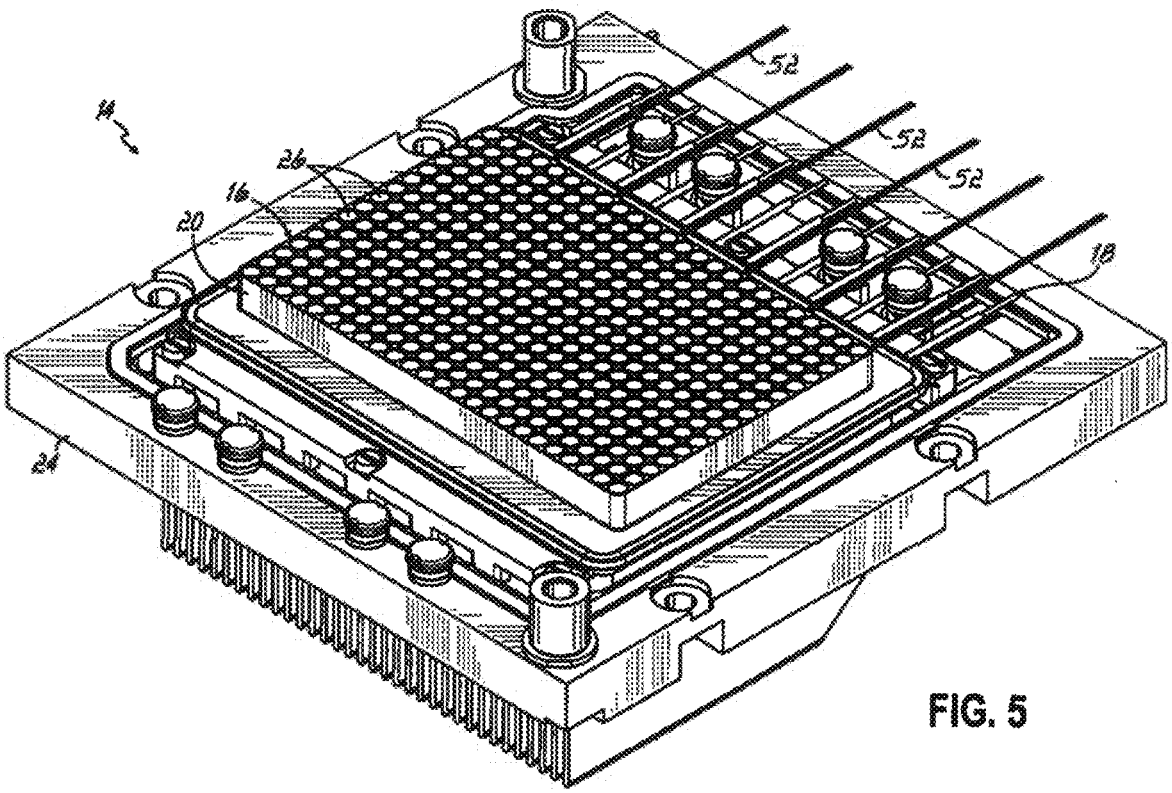
FIG. 5 is a perspective view of thermal block assembly of the biological analysis system of FIG. 1.

Referring to FIGS. 1-3, a biological analysis system, thermal cycler system 10, constructed in accordance with an illustrative embodiment of the invention is shown. Thermal cycler system 10 includes a drip pan 12, which includes an ejection mechanism (discussed further below), and a thermal block assembly 14, as shown in FIG. 4. The drip pan 12 seals the components of thermal block assembly 14 from environmental conditions above the drip pan 12. As shown best in FIG. 5, thermal block assembly 14 includes a sample block assembly 16, a heating and cooling element 18, and a heat exchanger or heat sink 24. The sample block assembly 16 includes a sample block 20 and a sample holder 22 (shown in FIGS. 12A and 12B). The sample block 20 includes a plurality of cavities 26 and is configured to be loaded with the correspondingly shaped sample holder 22 containing a plurality of biological or biochemical samples in a plurality of wells 28. More details of thermal cycler system 10 are discussed below.

Figure 6:
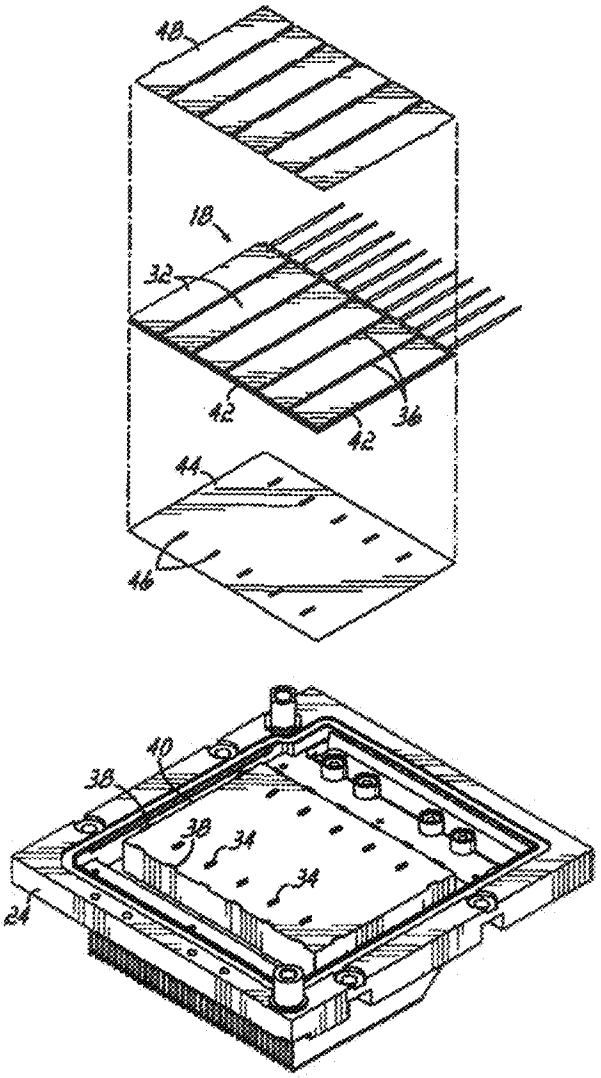
FIG. 6 is an exploded view of a portion of thermal block assembly of FIG. 5 with the sample block removed.

With reference to FIG. 6, the heating and cooling element 18 of thermal block assembly 14 is shown in more detail. The heating and cooling element 18 is used to uniformly heat and cool the sample block 20, which transfers heat to and from the samples in the wells 28 of the sample holder 22. The heating and cooling element 18 may include thermoelectric devices 32 such as, for example, Peltier devices. Although the heating and cooling element 18 is shown as including six thermoelectric devices 32, it should be recognized that the number of thermoelectric devices 32 may vary depending on a number of factors including, but not limited to, cost, the number of independent zones desired, and the size of the sample block 20.

With further reference to FIG. 6, the heat sink 24 of thermal block assembly 14 is shown in more detail. The heat sink 24 includes projections, such as posts or ridges, to secure the position of thermoelectric devices 32 relative to the heat sink 24. In this regard, the heat sink 24 includes ridges 34 arranged in rows and columns. In the illustrative embodiment, the rows of ridges 34 are aligned with the space between the adjacent thermoelectric devices 32. In other words, the ridges 34 are configured to extend through the heating and cooling element 18 and to engage the adjacent edges 36 of the individual thermoelectric devices 32. Depending on the number of thermoelectric devices 32, it should be recognized that the number and the configuration of the ridges 34 may be adjusted. Normally, irregularities on the surface of the heat sink 24 result in non-uniform dissipation of heat by the heat sink 24, which can result in non-uniform heating and cooling of the samples in the sample holder 22 positioned in the sample block 20. The ridges 34 do not introduce significant irregularities in the heat distribution between the heat sink 24 and the thermoelectric devices 32 because the ridges 34 engage the adjacent edges 36 rather than the surfaces of thermoelectric devices 32. The heat sink 24 also includes ridges 38 arranged around a peripheral edge 40 of the heat sink 24. The ridges 38 are configured to engage a peripheral edge 42 of the heating and cooling element 18. In this arrangement, the ridges 34, 38 secure the position of the heating and cooling element 18 relative to the heat sink 24 while preserving the uniformity of the heat distribution.

With reference again to FIG. 6, in one embodiment, the heating and cooling element 18 is thermally coupled to the heat sink 24 by a thermally conductive material 44. The thermally conductive material 44 has substantially the same dimensions as the heating and cooling element 18 and includes openings 46. The openings 46 are configured to align with the ridges 34 when the thermally conductive material 44 is positioned on the heat sink 24. When the heating and cooling element 18 and the thermally conductive material 44 are positioned on the heat sink 24, the ridges 34 extend through the openings 46 of the thermally conductive material 44 and the space between the adjacent thermoelectric devices 32 (as shown best in FIG. 12B). The thermally conductive material 44 improves the heat distribution between the heating and cooling element 18 and the heat sink 24. The thermally conductive material 44 may include, for example, a thermally conductive phase change material coated on each side of the thermally conductive material 44.

Still referring to FIG. 6, the heating and cooling element 18 is thermally coupled to the sample block 20 via a phase change layer 48. Depending on the design of the heating and cooling element 18, the phase change layer 48 can either be a single element having substantially the same dimensions as the heating and cooling element 18, or can be multiple elements each having substantially the same dimensions as the individual thermoelectric devices 32 of the multiple block design. As illustrated, the phase change layer 48 includes six elements corresponding to the six thermoelectric devices 32. Utilizing multiple elements of the phase change layer 48 aids in preventing excess phase change material from flowing between the thermoelectric devices 32. In one embodiment, the phase change layer 48 may be made of a foil coated with a thermally conductive phase change material. For example, the foil may be aluminum.

Figure 7:
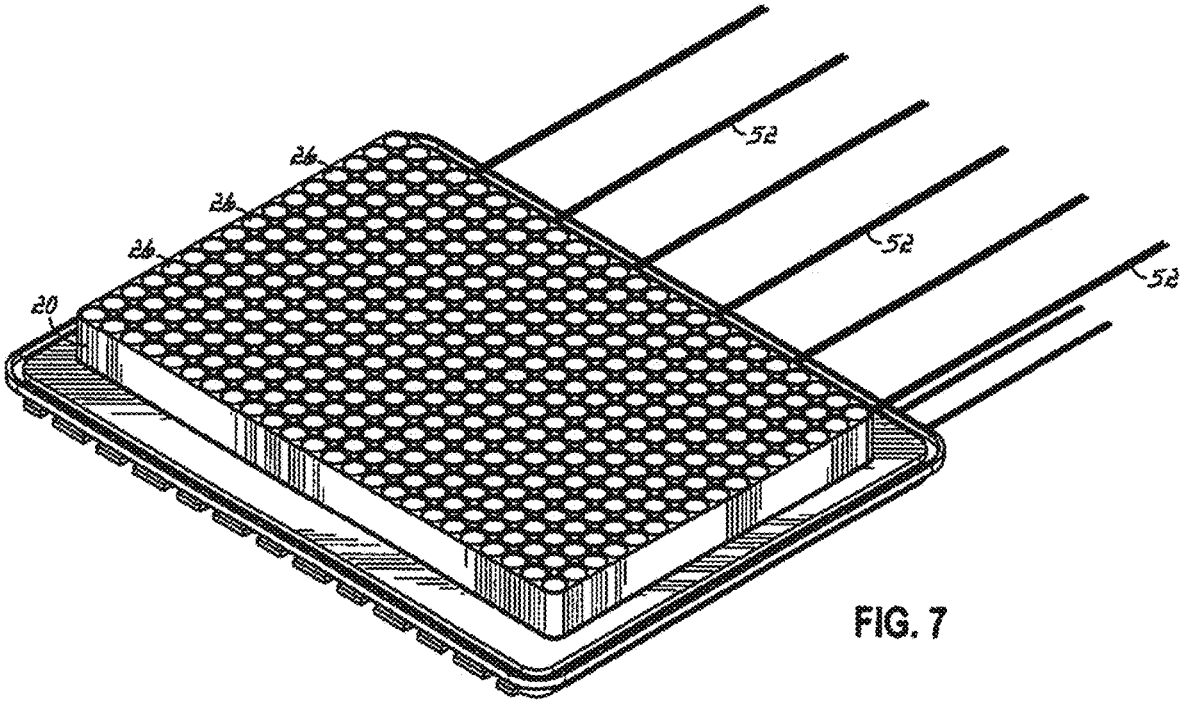
FIG. 7 is a perspective view of the sample block of thermal block assembly of FIG. 5.

With reference to FIG. 7, the sample block 20 is shown in more detail. As discussed above, in various embodiments, the sample block 20 may have a plurality of cavities 26 configured to receive a plurality of correspondingly shaped wells 28 of the sample holder 22. The wells 28 are configured to receive a plurality of samples, wherein the wells 28 may be sealed within the sample holder 22 via a lid, cap, sealing film or other sealing mechanism between the wells 28 and the heated cover. In the illustrative embodiment, the sample block 20 includes 384 cavities 26. In such an embodiment, the sample holder 22 may be a 384-well microtiter plate. It should be recognized that the sample block assembly 16 may have alternate configurations. For example, the sample holder 22 may be, but is not limited to, any size multi-well plate, card or array including, but not limited to, a 24-well microtiter plate, 50-well microtiter plate, a 96-well microtiter plate, a microcard, a through-hole array, or a substantially planar holder, such as a glass or plastic slide. The wells 28 in various embodiments of a sample holder 22 may include depressions, indentations, ridges, and combinations thereof, patterned in regular or irregular arrays formed on the surface of the sample holder 22. Sample or reaction volumes can also be located within wells or indentations formed in a substrate, spots of solution distributed on the surface a substrate, or other types of reaction chambers or formats, such as samples or solutions located within test sites or volumes of a microfluidic system, or within or on small beads or spheres. Samples held within the wells 28 may include one or more of at least one target nucleic acid sequence, at least one primer, at least one buffer, at least one nucleotide, at least one enzyme, at least one detergent, at least one blocking agent, or at least one dye, marker, and/or probe suitable for detecting a target or reference nucleic acid sequence.

The sample block 20 can be fixed, or clamped, to other components of the thermal block assembly 14 such as, for example, the heat sink 24. Alternatively, the sample block 20 can be floating. The floating sample block 20 may sit on a provided flat surface or surfaces to keep the sample block 20 substantially aligned with the other components of thermal block assembly 14. However, the floating sample block 20 can move laterally at all sides. Generally, such movement will be limited to prevent the sample block 20 from becoming misaligned with, for example, thermoelectric devices 32, the heat sink 24 and/or the heated cover. The assembly may provide, for example, an abutment (not shown) that constrains the lateral movement. Movement can be restrained, for example, to 1 mm at all sides. By allowing such constrained lateral movement, the floating block can adjust to any stacked up tolerances and misalignment that the block may have to the heated cover.

Figure 8:
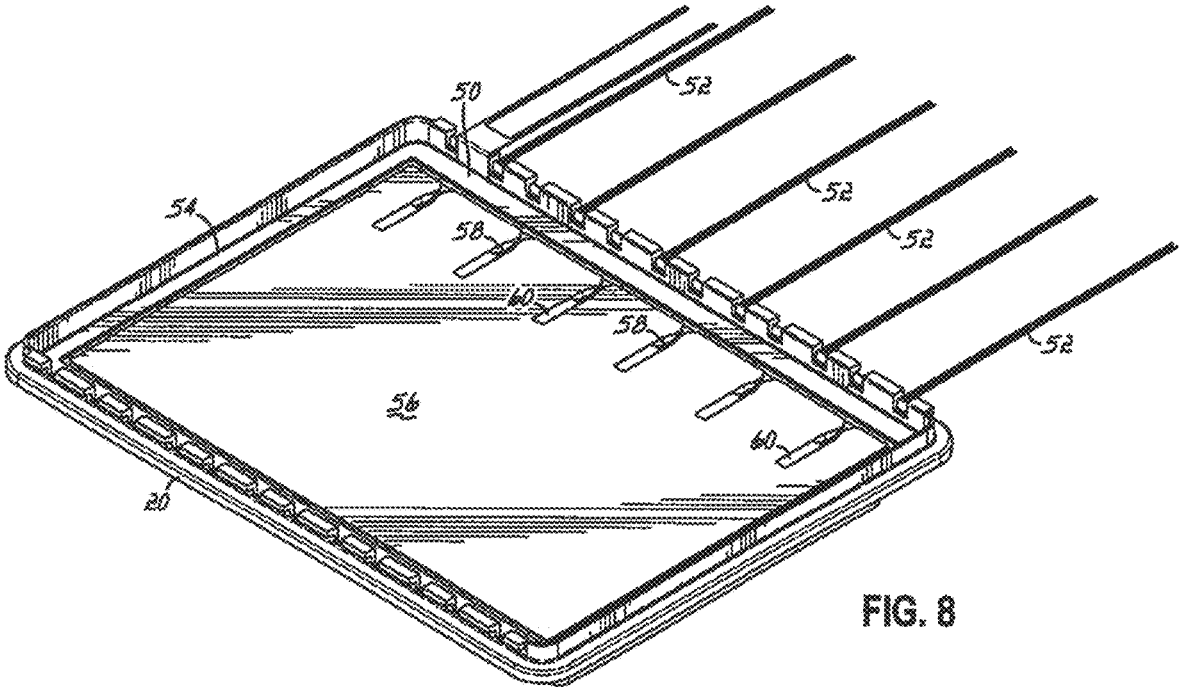
FIG. 8 is a perspective view of the underside of the sample block of FIG. 7 and associated components.
Figure 9:
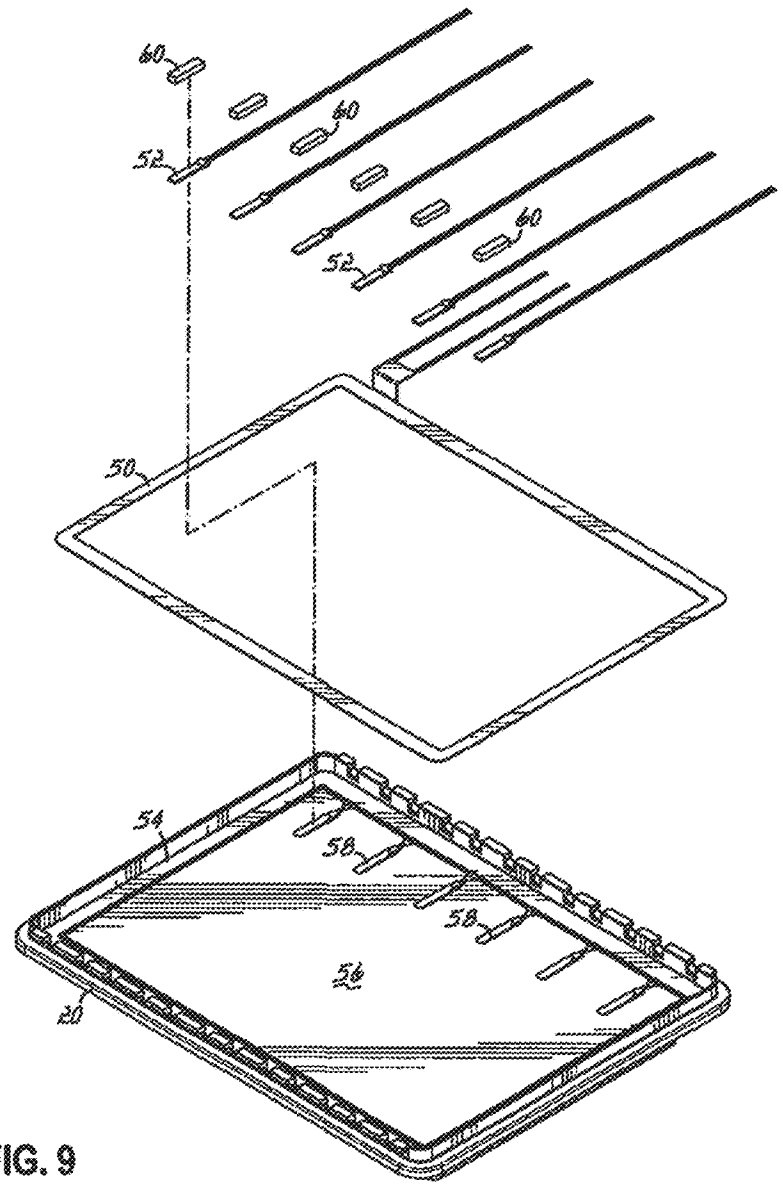
FIG. 9 is an exploded view of the underside of the sample block and associated components of FIG. 8.

With reference to FIGS. 8 and 9, additional components of the thermal block assembly 14 are shown in more detail. The illustrated thermal block assembly 14 includes a floating heater 50 and temperature sensors 52. The floating heater 50 may be located along an exterior perimeter ledge 54 of an underside 56 of the sample block 20. The floating heater 50 is used to offset colder temperatures near the cavities 26 around the perimeter of the sample block 20 as compared to more centrally located cavities 26. In one embodiment, the floating heater 50 can be a Kapton heater with one side coated with aluminum foil. The temperature sensors 52 are used to detect the temperature of the sample block 20 at discrete distances along the length thereof. The readings from the temperature sensors 52 provide insight into the heat distribution between the sample block 20 and the heat sink 24. Conventionally, temperature sensors have been welded to the sample block, which introduces irregularities in the surface of the sample block resulting in non-uniform heat distribution. In one embodiment, each temperature sensor 52 is positioned in a slot 58 in the underside 56 of the sample block 20. To counteract any negative effect caused by the temperature sensors 52 and the slots 58 on the uniformity of the heat distribution, each temperature sensor 52 is accompanied by a thermal interface pad 60. The thermal interface pads 60 may also act as a shock absorber between thermoelectric devices 32 and the temperature sensors 52. The thermal interface pads 60 are positioned adjacent to the temperature sensors 52 in the slots 58 and are flush with the underside 56 of the sample block 20. The thermal interface pads 60 may have a tacky or adhesive-like surface such that the temperature sensors 52 are generally held in place during assembly. In one embodiment, the thermal interface pads 60 are made of a material that has a lower thermal conductivity than the sample block 20. An exemplary suitable material is Gap Pad VO from Bergquist Company. As shown in FIG. 8, the thermal interface pads 60 may not extend the entirety of the length of each slot 58. The portion of the slot 58 not occupied by the temperature sensor 52 and the thermal interface pad 60 may be filled with a thermally conductive compound, such as thermal grease. Together, the temperature sensors 52 and the thermal interface pads 60 allow for detection of the heat distribution along the sample block 20 with reduced interference in the heat distribution caused by the temperature sensors 52 and the slots 58.

Figure 10:
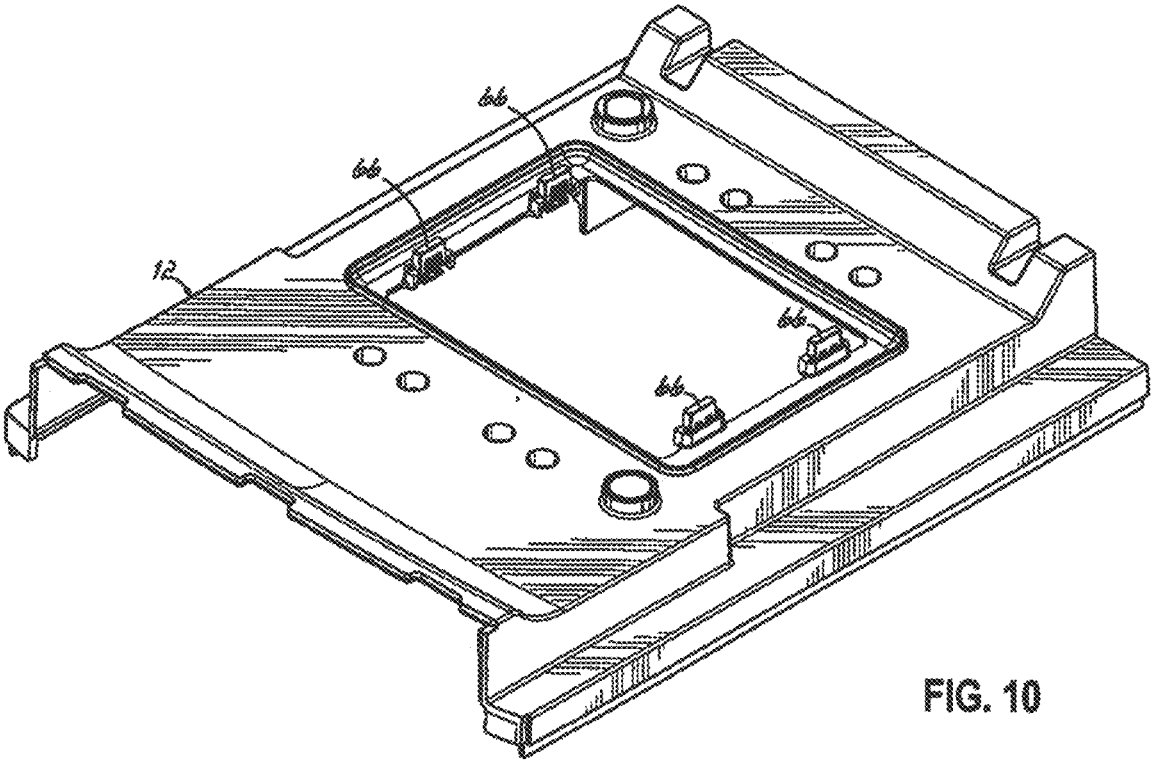
FIG. 10 is a perspective view of the drip pan and ejection mechanism of the biological analysis system of FIG. 1.
Figure 11:
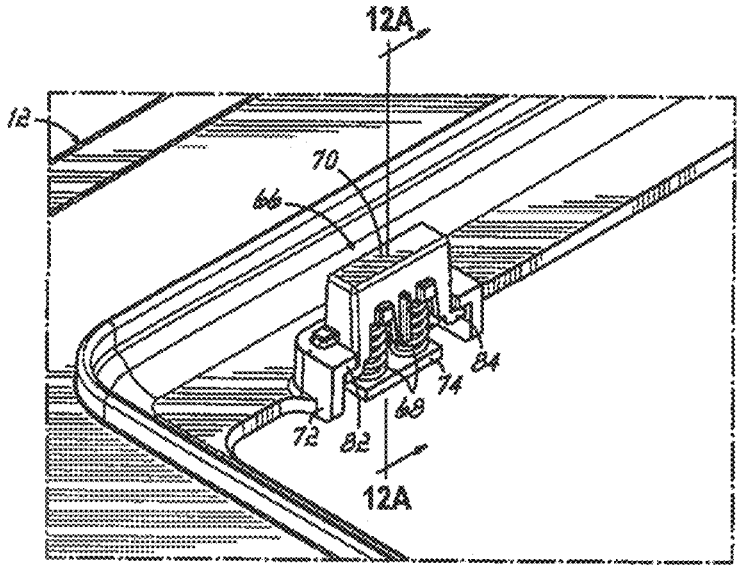
FIG. 11 is an enlarged view of the ejection mechanism of FIG. 10.

With reference now to FIGS. 10 and 11, thermal cycler system 10 includes the drip pan 12, which is placed over the sample block 20. The drip pan 12, along with an optional seal or gasket 62 (shown in FIGS. 12A and 12B), forms a seal between the sample block 20 and the drip pan 12 to isolate thermoelectric devices 32 from environmental conditions above the sample block 20 and the drip pan 12 with the wells 28 received in the cavities 26. In particular, the drip pan 12 prevents any sample that may splash out of the wells 28 from reaching the sensitive electronic components of the thermal block assembly 14. The sample holder 22 is positioned over the sample block 20 and the drip pan 12. A heated cover (not shown) may provide a downward force to the sample holder 22. The downward force provides vertical compression between the sample block assembly 16 and the other components of thermal block assembly 14, which improves thermal contact between the sample block 20 and the sample holder 22 to heat and cool the samples in the wells 28. The heated cover may also prevent or minimize condensation and evaporation above the samples contained in the wells 28, which can help to maintain optical access to samples. In conventional systems, after the PCR process is complete, the user typically pulls the sample holder 22 away from the sample block 20, which requires some force in order to release it. The force needed to remove the sample holder 22 may result in samples being spilled. To reduce the risk of spills and to increase the ease of removal of the sample holder 22, the drip pan 12 includes an ejection mechanism 64. In the illustrative embodiment, the ejection mechanism 64 includes caps 66, which each include two springs 68 and a cap cover 70.

With reference to FIGS. 12A-13B, the drip pan 12 includes housings 72 that engage the caps 66. Each housing 72 includes a ledge 74 having two posts 80 on which the springs 68 are positioned. The springs 68 include a first end 76 and a second end 78. The first ends 76 of the springs 68 are engaged with the posts 80, thus securing the position of the springs 68 relative to the housing 72. The second ends 78 of the springs 68 engage the cap cover 70 when the caps 66 move between an engaged position and an unengaged position (discussed further below). The housing 72 further includes a shoulder 82, and the cap cover includes an outer edge 84. The shoulder 82 is configured to engage the outer edge 84 and prevents the outer edge 84 from moving beyond the shoulder 82.

Figure 12A:
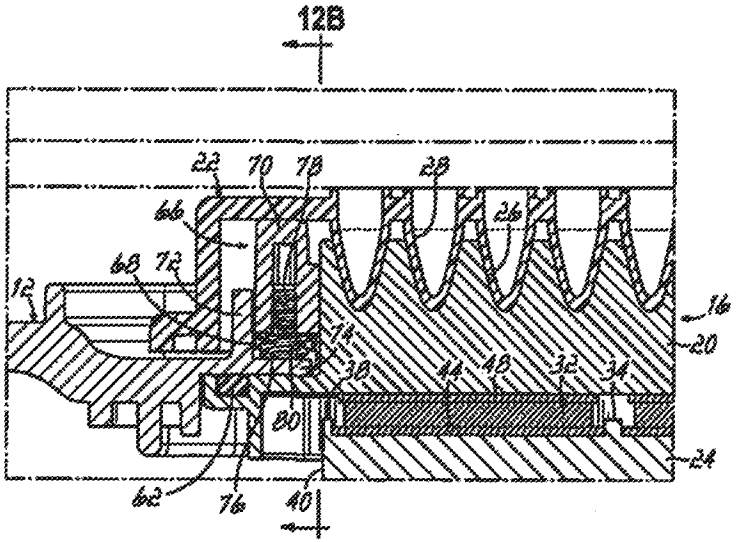
FIG. 12A is a cross-sectional view of the ejection mechanism taken along the line 12A-12A of FIG. 11 where the cap is in the depressed state.
Figure 12B:
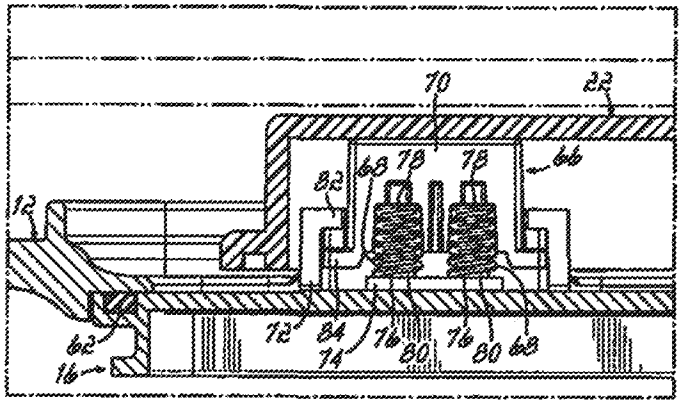
FIG. 12B is a cross-sectional view of the ejection mechanism taken along the line 12B-12B of FIG. 11 where the cap is in the depressed state.
Figure 13A:
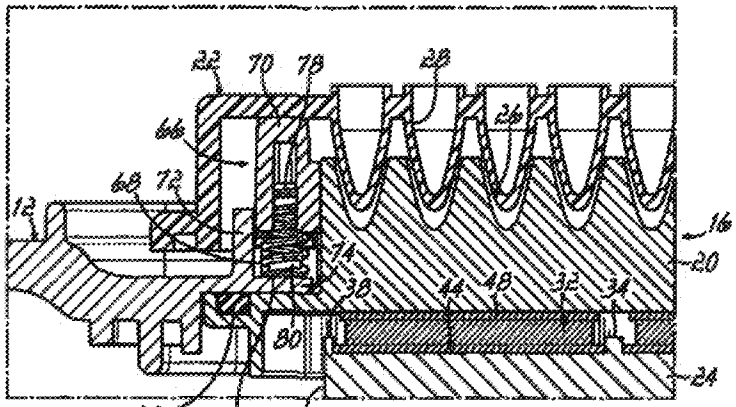
FIG. 13A is a cross-sectional view of the ejection mechanism taken along the line 12A-12A of FIG. 11 where the cap is in the expanded state.
Figure 13B:
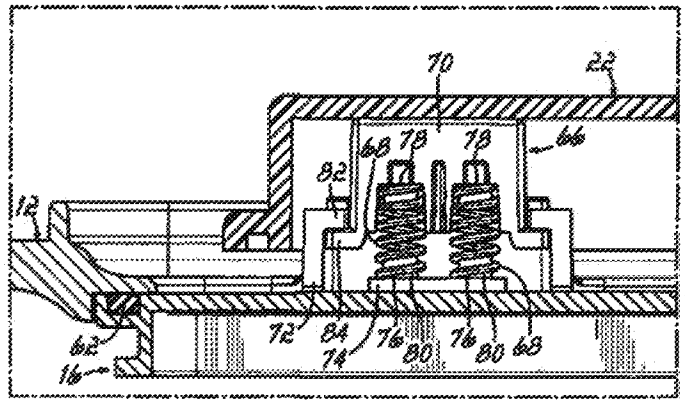
FIG. 13B is a cross-sectional view of the ejection mechanism taken along the line 12B-12B of FIG. 11 where the cap is in the expanded state.

With further reference to FIGS. 12A-13B, each cap 66 may have an engaged position and an unengaged position. FIGS. 12A and 12B illustrate an engaged, or compressed, position of a cap 66 that occurs when the heated cover (not shown) presses the sample holder 22 against the sample block 20. When heated cover provides a downward force against the sample holder 22, the sample holder 22 depresses the cap cover 70 (i.e., moves the cap cover 70 toward the ledge 74) causing the springs 68 to compress. After the PCR process is complete and the heated cover is opened, the downward force from the heated cover to hold the sample holder 22 against the sample block 20 is removed. Referring to FIGS. 13A and 13B, an unengaged, or extended, position of a cap 66 is shown where the sample holder 22 is raised from the sample block 20. Once the downward force from the heated cover is removed, the caps 66 eject the sample holder 22. As the springs 68 lengthen, the cap cover 70 moves away from the ledge 74 and the outer edge 84 of the cap cover 70 engages the shoulder 82. The removal of the sample holder 22 by the user now requires less force due to the separation between the sample holder 22 and the drip pan 12. Because of the increased ease of removal, there is a reduced risk of spilling the samples from the wells 28. In one embodiment, each spring 68 may have a force of about 0.4 kgf to about 0.5 kgf, meaning each cap 66 would have a force of about 0.8 kgf to about 1.0 kgf. Where a total of four caps 66 are included in the drip pan 12, a total force of about 3.2 kgf to about 4.0 kgf will be available to eject heated cover.

Figure 14:
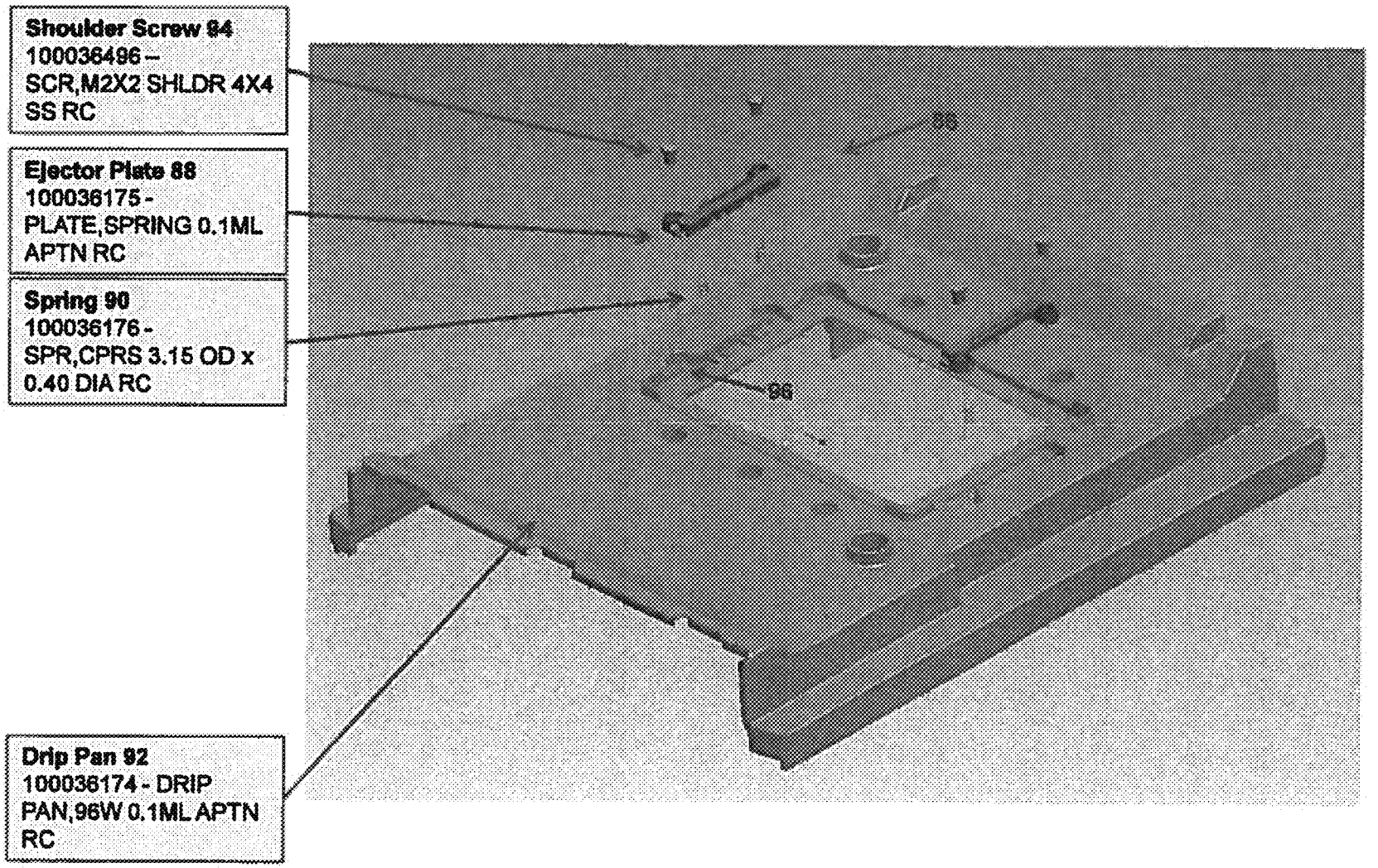
FIG. 14 is an exploded view of an ejection mechanism according to one embodiment.

With reference to FIGS. 14-15B, an exemplary ejection mechanism 86 is shown. In the illustrative embodiment, the ejection mechanism 86 includes two ejector plates 88, which each include two springs 90. The ejection mechanism 86 may be coupled to a drip pan 92 via shoulder screws 94. As shown in FIG. 14, a drip pan 92 includes recesses 96 that correspond to the ejector plates 88. Ends of the springs 90 engage the ejector plates 88 when the ejector plates 88 move between an engaged or compressed position and an unengaged or expanded position (discussed further below). The shoulder screws 94 are configured to engage a portion of the ejector plates 88 and prevent the ejector plates 88 from moving beyond the unengaged position.

With reference to FIGS. 15A and 15B, the engaged and disengaged positions of the ejector plates 88 are shown, respectively. FIG. 15A illustrates the engaged, or compressed, position of an ejector plate 88 that occurs when the heated cover (not shown) presses the sample holder 22 against the sample block 20. When the heated cover provides a downward force against the sample holder 22, the sample holder 22 depresses the ejector plate 88 (i.e., moves the ejector plate 88 in a direction toward a ledge 98 of the drip pan) causing the springs 90 to compress. After the PCR process is complete and the heated cover is opened, the downward force from the heated cover to hold the sample holder 22 against the sample block 20 is removed. Referring to FIG. 15B, the unengaged, or extended, position of an ejector plate 88 is shown where the sample holder 22 is raised from the sample block 20. Once the downward force from the heated cover is removed, the ejector plate 88 ejects the sample holder 22. As the springs 90 lengthen, the ejector plate 88 moves away from the ledge 98 and a portion of the ejector plate 88 engages the shoulder screws 94. The removal of the sample holder 22 by the user now requires less force due to the separation between the sample holder 22 and the drip pan 92. In one embodiment, the springs 90 may extend the ejector plates 88 a distance of 2 mm from the engaged position to the disengaged position. Because of the increased ease of removal, there is a reduced risk of spilling the samples from the wells 28.

Although not shown, thermal cycler system 10 may include a variety of other modules and systems to perform thermal cycling. For example, thermal cycler system 10 may include an optical system. The optical system may have an illumination source that emits electromagnetic energy, an optical sensor, detector, or imager, for receiving electromagnetic energy from samples in the sample holder 22, and optics used to guide the electromagnetic energy from each DNA sample to the imager. Thermal cycler system 10 may further include a control system and/or a computer system capable of controlling the operation of thermal cycler system 10. Embodiments of the present invention may be applicable to any PCR process, experiment, assay, or protocol where a large number of samples or solutions test volumes are processed, observed, and/or measured.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A thermal block assembly for use in a biological analysis system comprising:

a heating and cooling element;

a phase change layer;

a sample block thermally coupled to the heating and cooling element via the phase change layer and configured to accommodate a sample holder, the sample holder configured to receive a plurality of samples, said sample block having an upper surface with one or more cavities configured to accommodate the sample holder, the sample block including a lower surface configured to be thermally coupled to the heating and cooling element, the lower surface including a plurality of slots adapted for receiving a plurality of temperature sensors and a corresponding plurality of thermal pads, said thermal pads being made of a material that has a lower thermal conductivity than the sample block;

wherein the plurality of temperature sensors is configured to extend through the plurality of slots of the lower surface of the sample block; and wherein each thermal pad of the plurality of thermal pads is also positioned in one of the slots between a corresponding temperature sensor of the plurality of temperature sensors and the heating and cooling element;

a heat sink including a surface, the surface including a plurality of projections for engaging the heating and cooling element to hold the heating and cooling element on the heat sink; and a drip pan configured for engaging the sample block to seal the heating and cooling element and the heat sink from the plurality of samples in the sample holder when the sample holder is positioned on the sample block, the drip pan including an ejection mechanism for ejecting the sample holder from the sample block, wherein the ejection mechanism includes one or more caps, each cap including a cap cover and at least one spring, and wherein each of the one or more caps are coupled to the drip pan by a housing, the housing having a shoulder and the cap cover including an outer edge, the shoulder configured to engage the outer edge.

2. The thermal block assembly of claim 1, wherein the sample block has 384 cavities.

* * * * *